United States Patent [19]

Paul, Jr.

[11] 3,954,355

[45] May 4, 1976

[54] ROTARY ENERGY CONVERTER

[76] Inventor: Herman L. Paul, Jr., Box 344 R.D. 5, Lebanon, Pa. 17042

[22] Filed: Nov. 1, 1974

[21] Appl. No.: 519,921

Related U.S. Application Data

[63] Continuation-in-part of Ser. No. 392,072, Aug. 27, 1973, Pat. No. 3,876,348.

[52] U.S. Cl. ..... 418/9; 418/112; 418/129; 418/164; 418/212

[51] Int. Cl.[2] ..... F04C 23/00; F04C 27/00; F04C 17/00

[58] Field of Search ..... 418/9, 112, 125, 129, 418/141, 160, 161, 164, 168, 212

[56] References Cited

UNITED STATES PATENTS

| | | | |
|---|---|---|---|
| 724,665 | 4/1903 | Cooley | 418/168 X |
| 749,712 | 1/1904 | Allen | 418/125 |
| 914,627 | 3/1909 | Alcorn | 418/168 X |
| 1,046,244 | 12/1912 | Yates | 418/125 |
| 1,543,163 | 6/1925 | Johnson et al. | 418/63 X |
| 2,232,983 | 2/1941 | Wahlmark | 418/9 X |

FOREIGN PATENTS OR APPLICATIONS

| | | | |
|---|---|---|---|
| 1,000,029 | 1/1957 | Germany | 418/161 |
| 961,872 | 6/1964 | United Kingdom | 418/168 |

*Primary Examiner*—C. J. Husar
*Assistant Examiner*—Leonard Smith
*Attorney, Agent, or Firm*—Thomas E. Tate

[57] ABSTRACT

The disclosure is that of an invention directed to a rotary energy converter so constructed that it may be used either as in internal or external combustion engine, a fluid pump or as a gas or air compressor. The basic configuration consists of a stationary housing within which is rotatably mounted a disc-like primary circular rotor having a parallel-sided chamber symmetrically disposed with respect to its axis of rotation and a secondary circular rotor rotatable within the parallel sides of the chamber of the primary rotor and eccentrically affixed to a shaft that is mounted within the housing for rotation about an axis that is disposed in parallel offset relation to that of the primary rotor. The relation between the diameter of the secondary rotor within the parallel sides of the chamber of the primary rotor and the distance between the axes of the primary rotor and the shaft being such that for each revolution of the primary rotor with respect to the housing two revolutions of the shaft will occur and that due to the relative motions between the primary and secondary rotors there will be only a single relative revolution between the primary and secondary rotors. The housing and opposite ends of the primary rotor chamber are suitably ported for intake and discharge and the basic configurations may be arranged in multiples for operation with respect to a single shaft common to all secondary rotors. The basic configurations also may be arranged in dual units, each of which functions with suitable inter-stage manifolding as a two stage assembly, in order to provide substantially 360° power operation.

11 Claims, 27 Drawing Figures

ROTARY ENERGY CONVERTER

RELATED APPLICATIONS

This application is a continuation-in-part of application Ser. No. 392,072, filed Aug. 27, 1973 now U.S. Pat. No. 3,876,348, granted Apr. 8, 1975. Related application Ser. No. 488,717, filed July 15, 1974, now U.S. Pat. No. 3,890,941, granted June 24, 1975 is a division of Ser. No. 392,072.

THE INVENTION

This invention relates generally to new and useful improvements in rotary types of internal combustion engines, pumps or compressors and particularly seeks to provide a novel rotary energy converter for such purposes.

Heretofore, such machines typically have required either; (1) the use of a fixed or rotary housing provided with a multi-lobed chamber within which a multi-lobed offset rotor rotates, thus creating one or more variable capacity compression or expansion chambers; or (2) have required the use of axially reciprocable pistons acting against a swash or wobble plate; or (3) have required the use of relatively angularly variable rotor vanes in order to provide the necessary changes in the volumetric capacities of the respective chambers.

For example, the so-called "Wankel" engines or their equivalents are representative of type (1) above; the so-called "Stirling-cycle" engines or their equivalents are representative of type (2) above; and the so-called "Ryenco" engines or their equivalents are representative of type (3) above. These types of engines have been mentioned merely as exemplary of the many different approaches that heretofore have been made in efforts to produce more efficient or simpler types of internal or external combustion engines.

However, even the simpler mechanical approaches, such as those represented by type (1) above, still have not solved the problem since they all appear to require either the use of variable radius or line contact seals, or inherently unbalanced relatively moving parts or complicated valving in order to operate properly, even for relatively limited lengths of time before requiring parts, replacement or rebuilding to restore the desired operating efficiency.

In contrast, a rotary energy machine constructed in accordance with this invention does not require the use of a multi-lobed rotor rotating within a complementary multi-lobed chamber, thus eliminating the variable distance line contact sealing problem between the lobes of the rotor and the walls of the chamber and provides a greatly simplified construction capable of high or low speed operation either as an internal or external combustion engine, as a compressor or expander or as a pump, all of which versions employ essentially the same moving parts operating in the same manner. The machine may be constructed in single, twin or multiple units each of which comprises simply a stationary housing that supports an internal circular primary rotor rotatable about one fixed axis and having a parallel-sided symmetrically disposed chamber extending along a diameter thereof, a drive or driven shaft extending through the housing and rotatable about a second fixed axis that is offset from and parallel to the axis of the primary rotor, and a circular secondary rotor mounted within the chamber of the primary rotor and eccentrically affixed to the drive or driven shaft. The housing is provided with intake and exhaust ports and passages that are complementary to corresponding ports or accesses formed in the primary rotor for communication with the interior of the chamber thereof as the respective ports come into registry during rotation of the primary rotor.

In the constructions used for operation as liquid pumps or as air or gas vacuum pumps or compressors, the units may be of single, twin or multiple chamber construction operating from a common drive shaft, with the housing being provided with a single pair of intake and exhaust ports for common communication with all of the operative chambers, or may be of multiple stage construction for progressive pumping or evacuating effect.

Therefore, an object of this invention is to provide a rotary energy machine that includes essentially only two moving parts namely, a circular primary rotor-mounted within a stationary housing for rotation about one fixed axis and having a parallelsided symmetrically disposed chamber extending along a diameter thereof and a circular secondary rotor mounted within the chamber of the primary rotor between the parallel side walls thereof and eccentrically affixed to a drive or driven shaft carried by the stationary housing for rotation about a second fixed axis that is offset from and parallel to the axis of the primary rotor, whereby to effect cyclically varying increasing and decreasing volumes at the ends of the chamber of the primary rotor as that rotor and the secondary rotor continuously rotate in the same direction at differential speeds.

Another object of this invention is to provide a machine of the character stated in which a sliding seal is effected between the periphery of the secondary rotor and the parallel walls of the chamber of the primary rotor through the use of a ring seal freely mounted on the secondary rotor, or through the use of an internally pressurized ring-seal mounted on the secondary rotor.

Another object of this invention is to provide a machine of the character stated in which the parallel walls of each chamber of the primary rotor are provided with yieldably mounted wear plates or seals disposed for relative sliding contact with the ring seal of the associated secondary rotor.

Another object of this invention is to provide a machine of the character stated in which peripheral and face seals are operably associated with the primary rotor.

Another object of this invention is to provide a machine of the character stated that can be fabricated in multiple units for operation along a common drive or driven shaft and in which successive units are angularly offset with respect to preceding units to the degree necessary to establish and maintain mechanical and operational balance.

Another object of this invention is to provide a machine of the character stated in which each unit thereof is organized as a two or more chambered or a two or more stage balanced assembly.

A further object of this invention is to provide a machine of the character stated that effects a high ratio of volumetric capacity per unit weight.

A further object of this invention is to provide a machine of the character stated that may be operated at a high rotational speeds over prolonged periods of time without substantial loss in efficiency.

A further object of this invention is to provide a machine of the character stated that, when operated as an internal combustion engine, will produce an exhaust containing a minimum of atmospheric pollutants.

With these and other objects, the nature of which will become apparent, the invention will be more fully understood by reference to the drawings, the accompanying detailed description and the appended claims.

Figure 1:
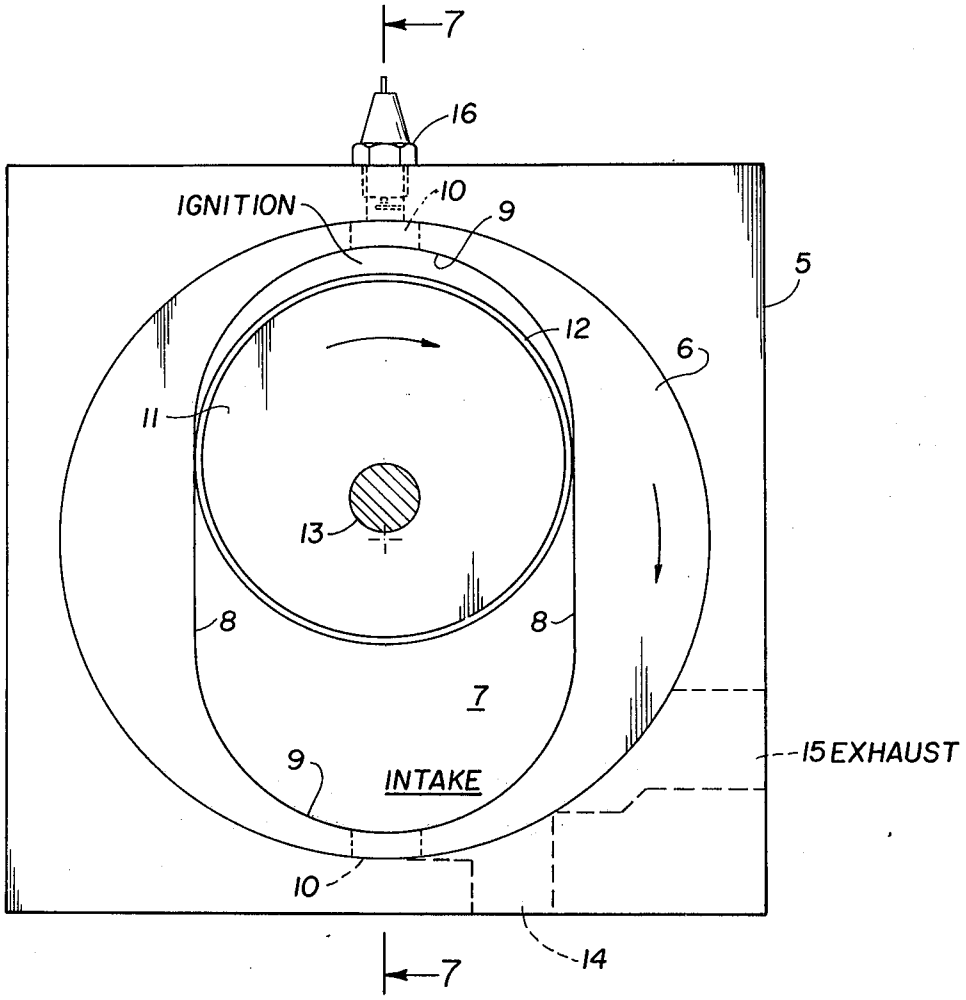
FIGS. 1–6 are generally schematic open front elevational views, taken along line 1—1 of FIG. 7, of a single unit rotary energy machine constructed in accordance with this invention for use as a two cycle internal combustion engine and successively show the relative movements between the primary rotor and the secondary rotor during each full revolution of the secondary rotor.
Figure 9:
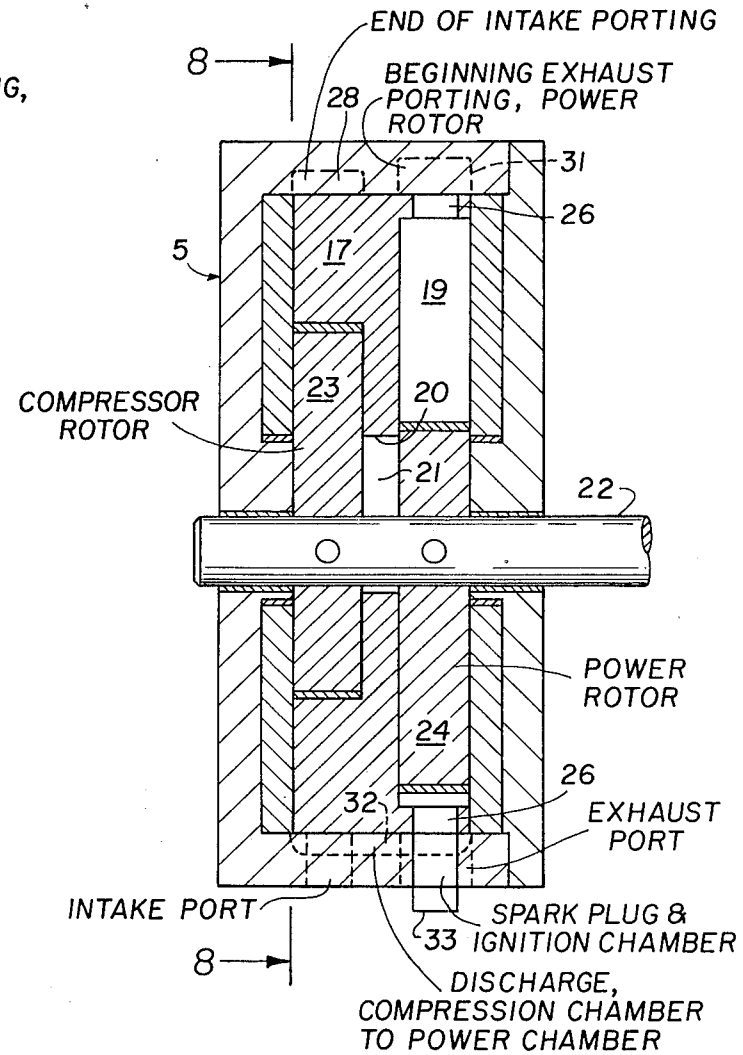
Figure 8:
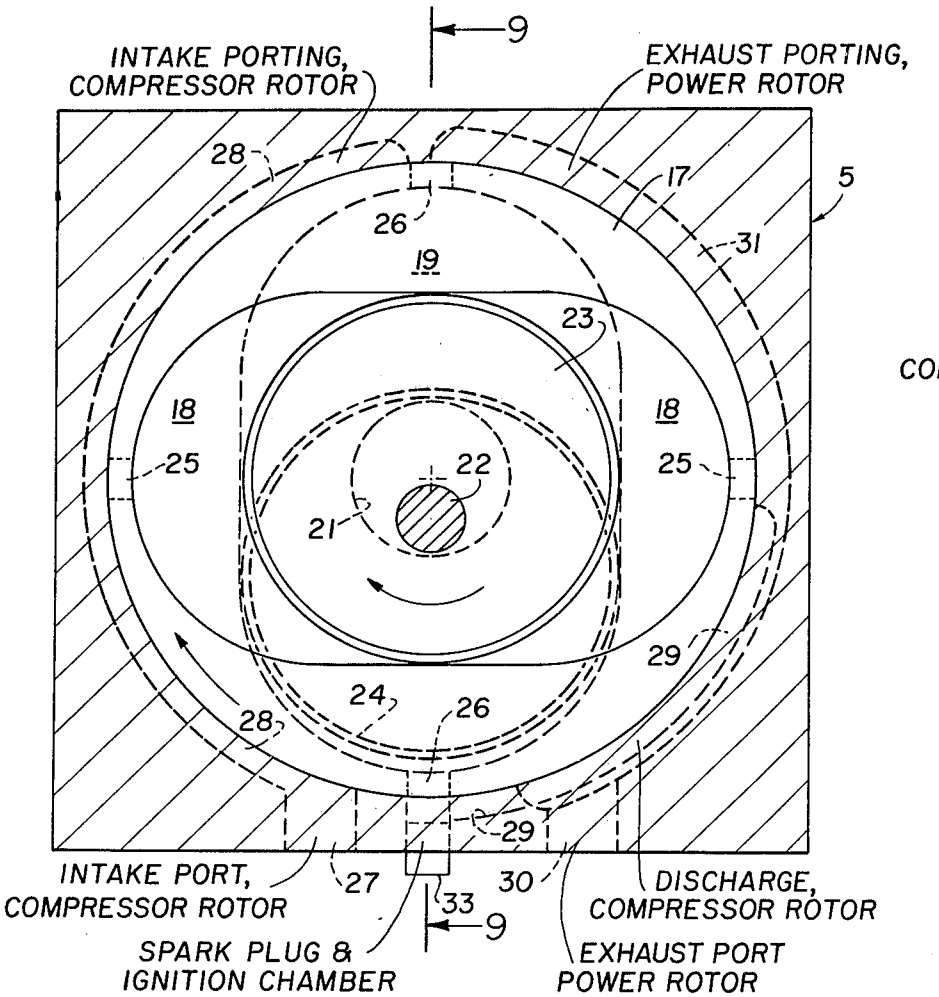

FIG. 8 is a generally schematic open front elevational view similar to that of FIG. 1, but taken along line 8—8 of FIG. 9, and showing a two stage internal combustion unit for substantially 360° power rotation in which the primary rotor is provided with two 90° angularly offset front and back chambers, the front chamber being shown in full lines and the back in dotted lines, and in which a secondary rotor is provided for each chamber and suitable interstage ports and passages are provided within the housing.

Figure 11:
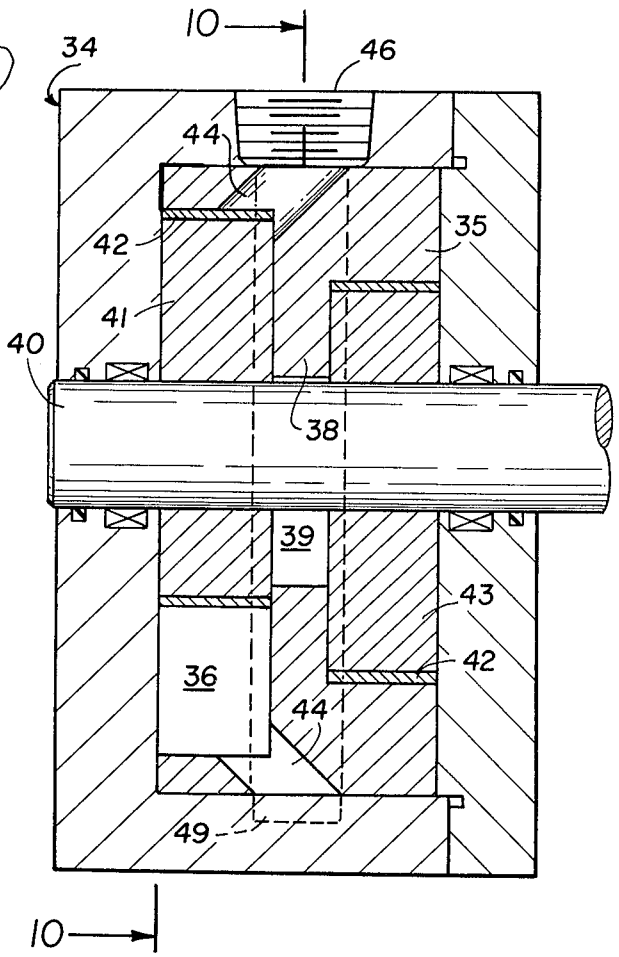
Figure 10:
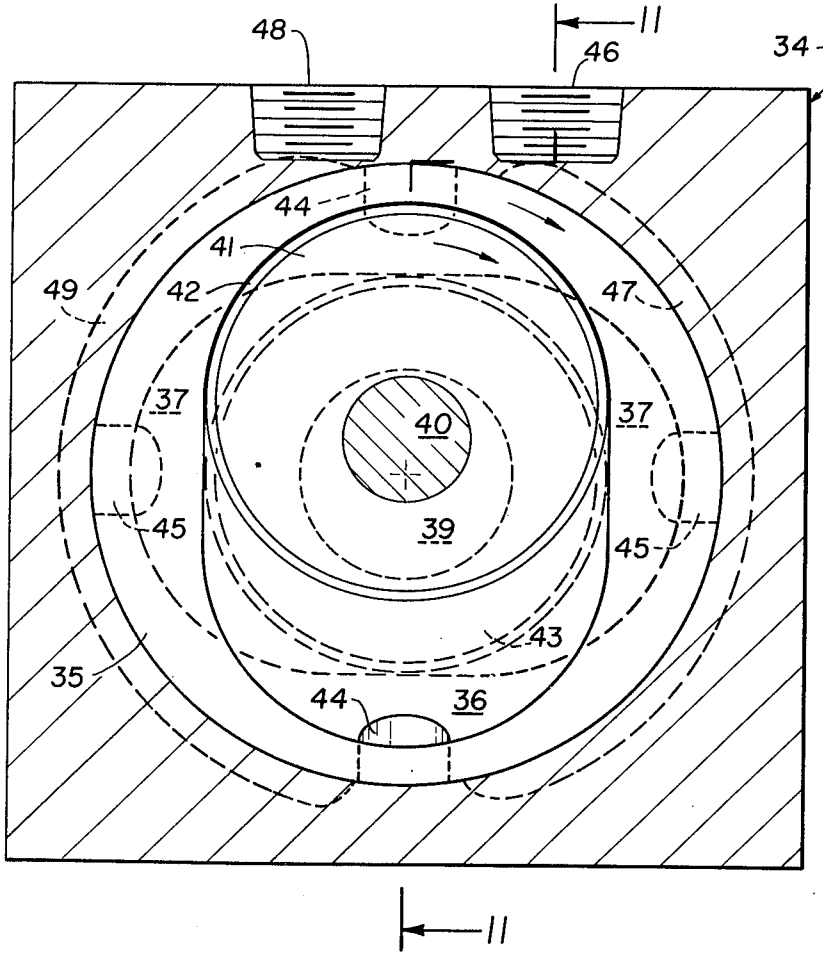

FIG. 9 is a vertical longitudinal section taken along line 9—9 of FIG. 8;

FIGS. 10 and 11 are comparable to FIGS. 8 and 9, but illustrate one manner in which the machine may be adapted for use as a hydraulic pump. Here, FIG. 10 is an offset transverse vertical section taken along line 10—10 of FIG. 11 and FIG. 11 is an offset longitudinal vertical section taken along line 11—11 of FIG. 10.

Figure 14:
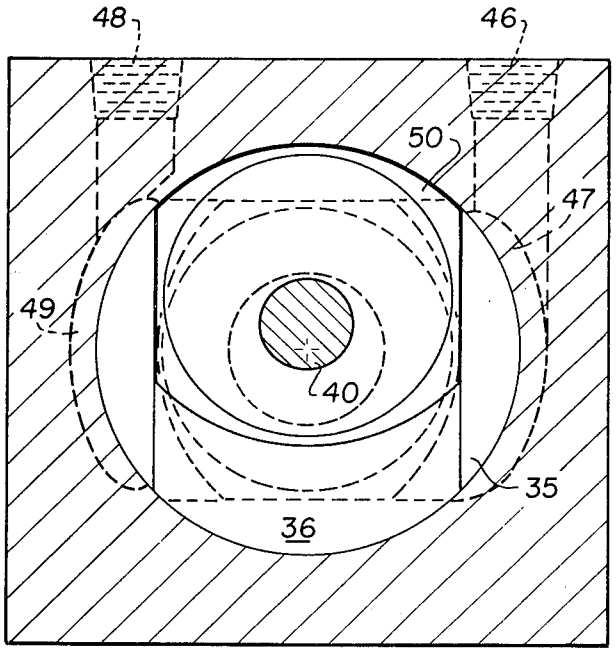
Figure 13:
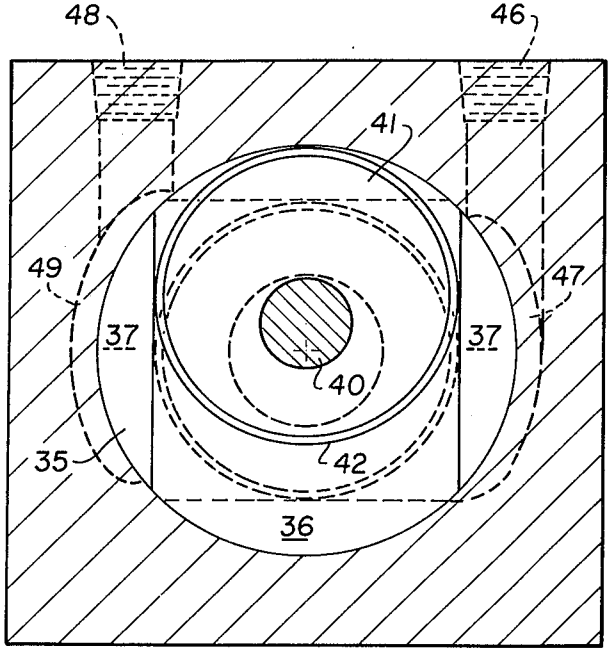
Figure 12:
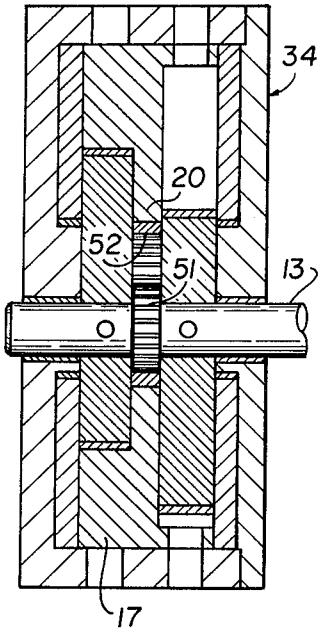

FIG. 12 is a longitudinal section similar to FIG. 9 but additionally showing a pinion gear affixed to the driven shaft and a mating internal ring gear affixed to the primary rotor to maintain a fixed rotative rotio therebetween;

FIG. 13 is a view similar to FIG. 10 but showing a pump modification in which the chambers of the primary rotor are openended;

FIG. 14 is a view similar to FIG. 13 but showing a specially configured seal ring on each secondary rotor and having a pair of parallel flat faces disposed in sliding contact with the side walls of the respective chambers.

Figure 16:
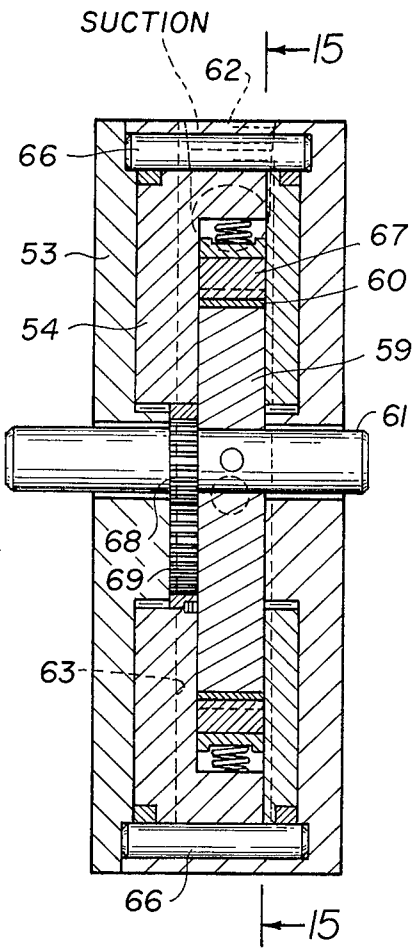
Figure 15:
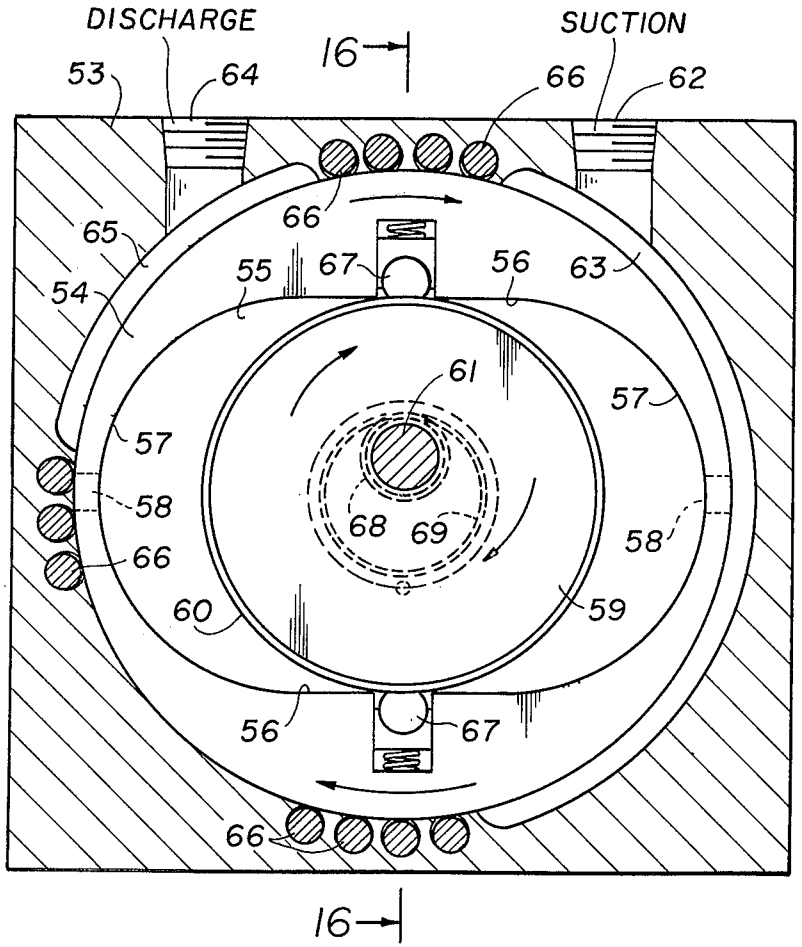
Figure 20:
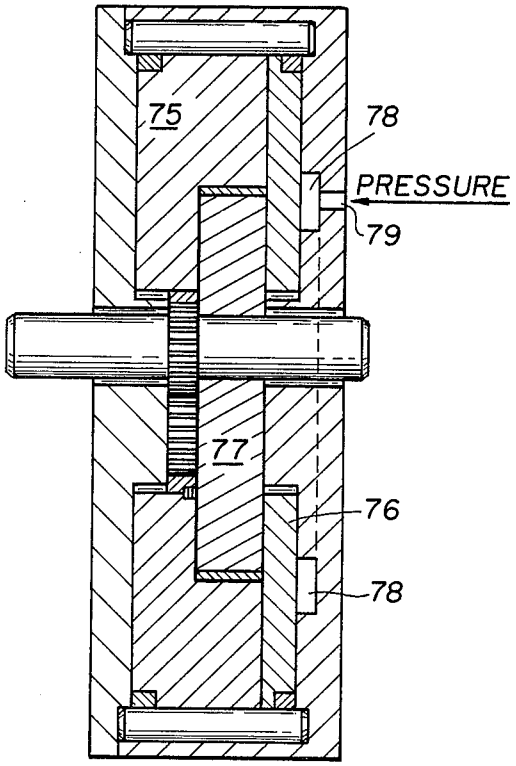
Figure 19:
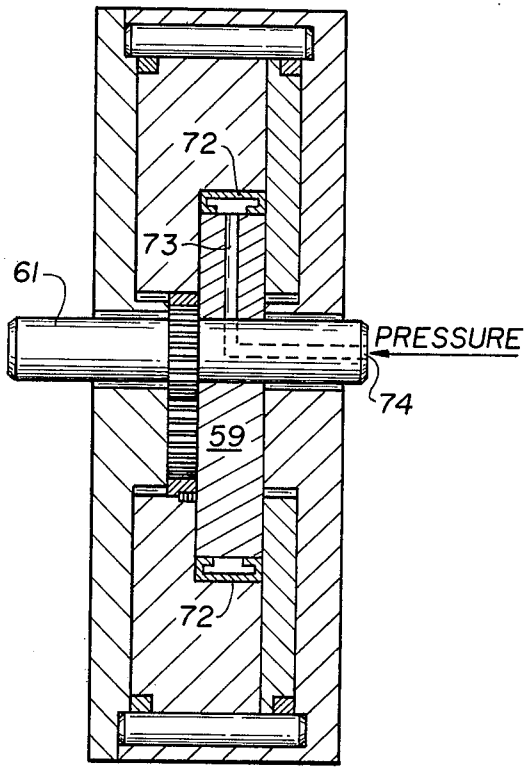
Figure 17:
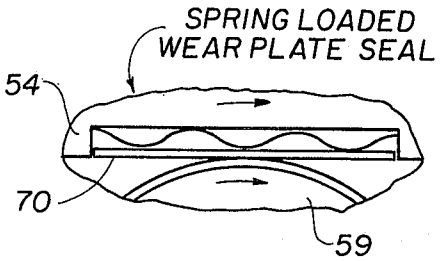
Figure 18:
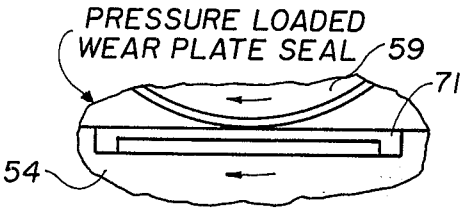
Figure 22:
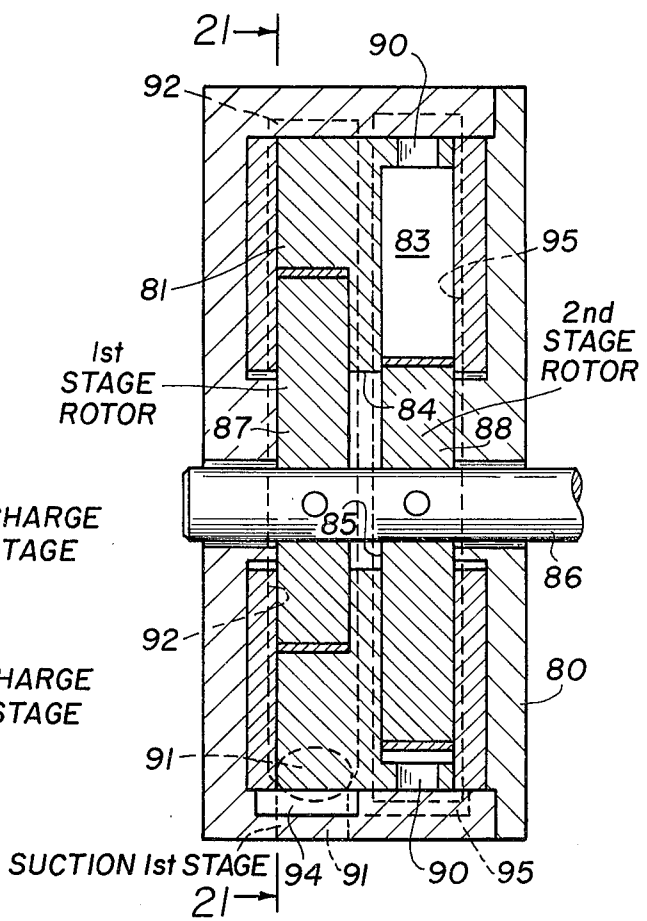
Figure 21:
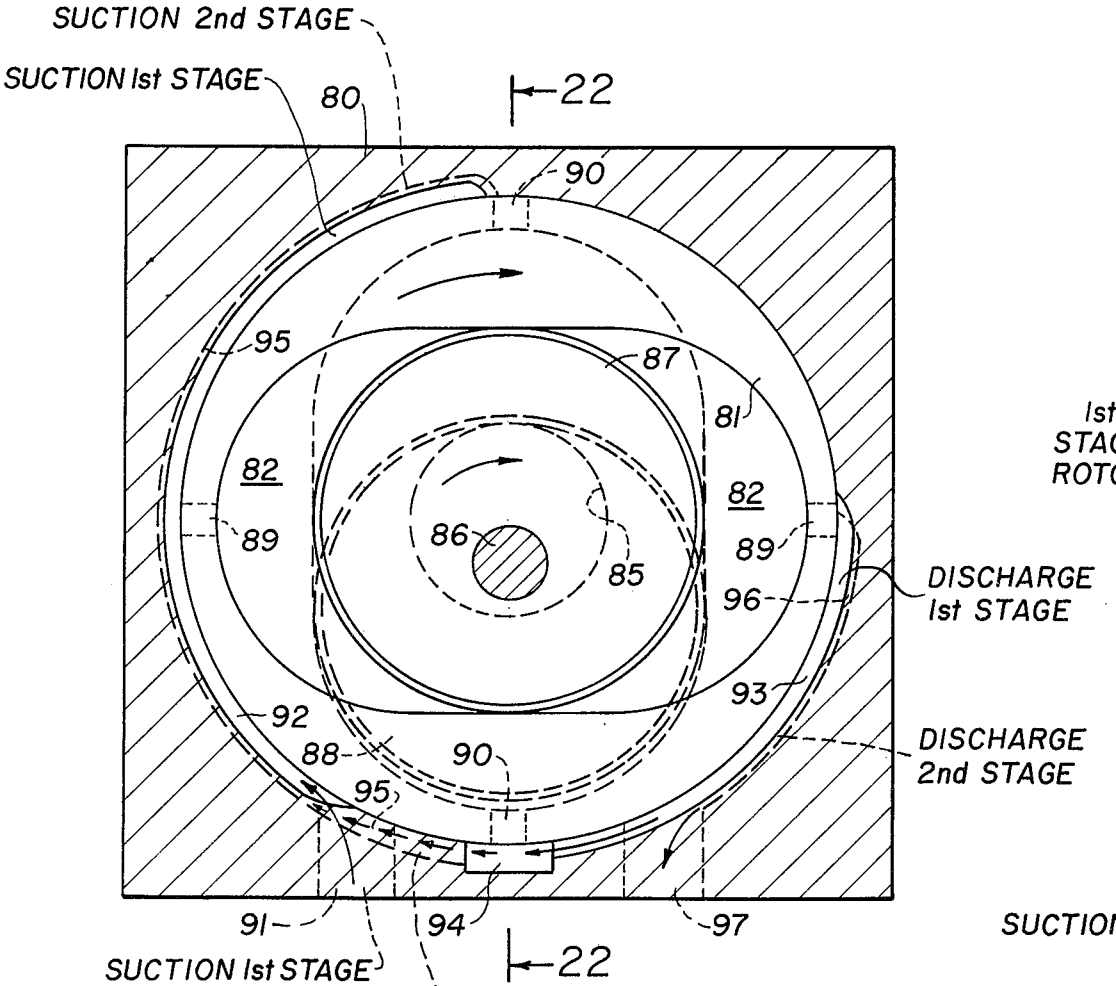
Figure 23:
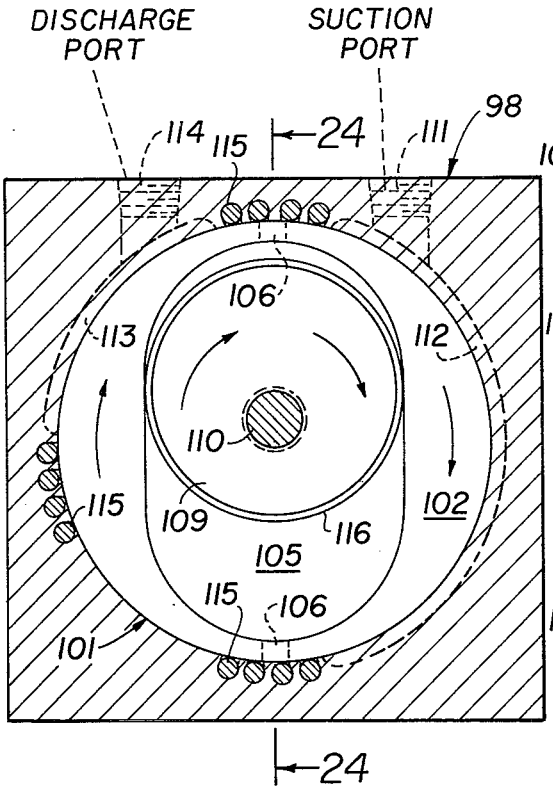
Figure 24:
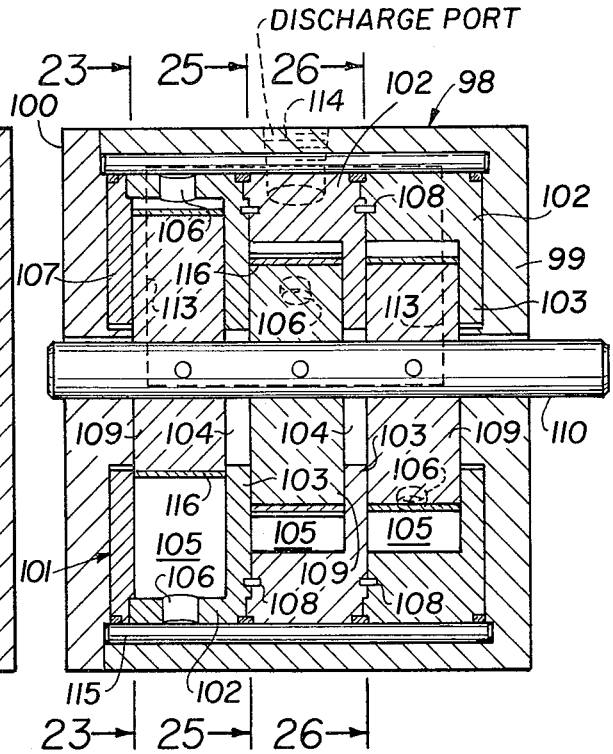
Figure 25:
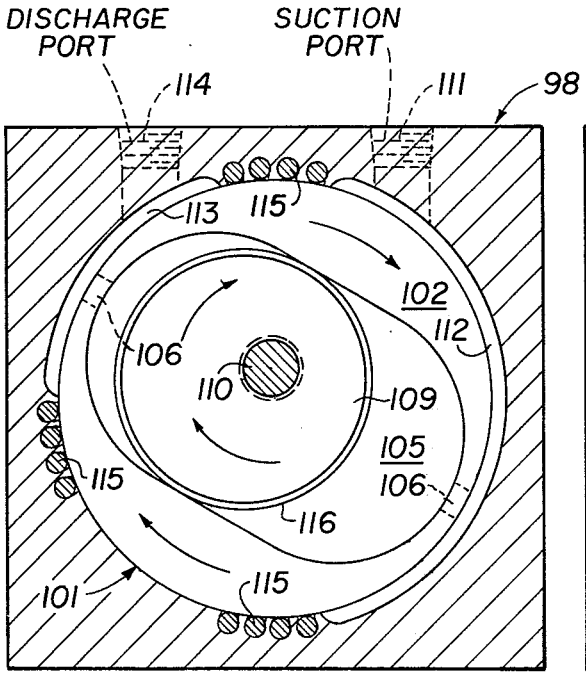
Figure 26:
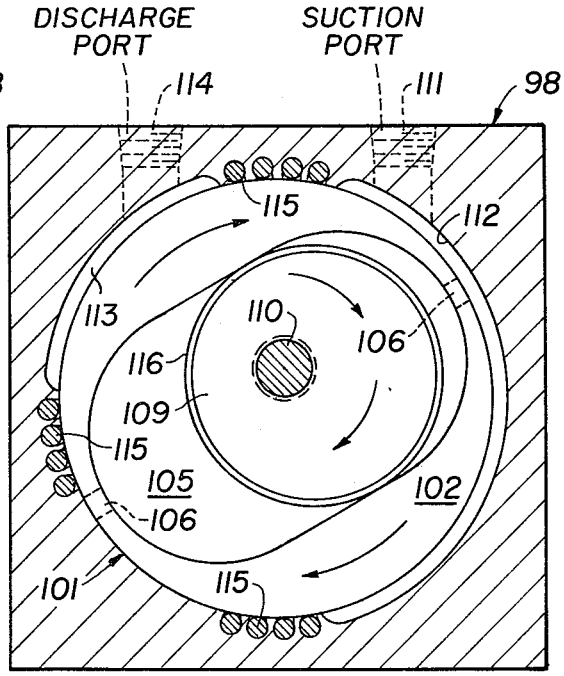
Figure 27:
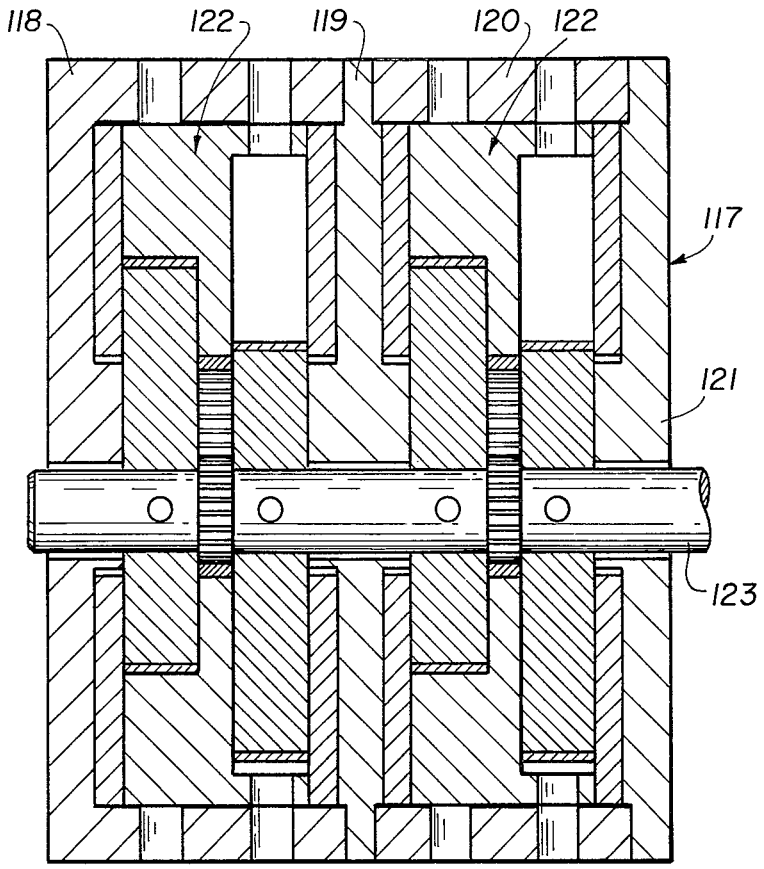

FIG. 15 is a schematic open front elevational view, taken along line 15—15 of FIG. 16, of a single chamber rotary compressor;

FIG. 16 is a longitudinal vertical section taken along line 16—16 of FIG. 15;

FIG. 17 is a detail elevational view showing the use of a spring loaded wear plate seal that may be used in place of the generally cylindrical seal of FIG. 15;

FIG. 18 is a view similar to FIG. 17 but showing a pressure loaded wear plate seal;

FIG. 19 is a view similar to FIG. 16 but showing an internally pressurized ring seal on the secondary rotor;

FIG. 20 is a view similar to FIG. 19 but showing the use of a pressure loaded free side plate for the primary rotor;

FIG. 21 is a schematic open front elevational view, taken along line 21—21 of FIG. 22, of a two stage compressor;

FIG. 22 is a longitudinal vertical section taken along line 22—22 of FIG. 21;

FIG. 23 is a schematic open front elevational view, taken along line 23—23 of FIG. 24, of a three chamber compressor;

FIG. 24 is a longitudinal vertical section taken along line 24—24 of FIG. 23;

FIG. 25 is a transverse vertical section taken along line 25—25 of FIG. 24;

FIG. 26 is a transverse vertical section taken along line 26—26 of FIG. 24; and FIG. 27 is a longitudinal vertical section similar to FIG. 24 but showing a multi-chamber compressor having four chambers arranged in pairs of two chambers each for modular assembly.

Referring to the drawings in detail the invention, as illustrated, is embodied in a rotary energy machine in which each operative unit or sub-unit, regardless of its end use function, comprises essentially only three elements namely, a stationary housing, a circular primary rotor having a parallel sided diametric chamber and a secondary rotor rotatable within the chamber of the primary rotor and affixed eccentrically to a drive or driven shaft carried by the housing for rotation about an axis disposed in offset parallel relation with respect to the axis of the primary rotor.

For example, FIGS. 1–7 schematically illustrate how the principles of this may be applied to a single unit for operation as a two-cycle engine that includes a stationary housing generally indicated 5, and a circular primary rotor 6 mounted within the housing 5 for rotation about its own fixed axis and having a symmetrically disposed diametrically extending internal chamber generally indicated 7 provided with parallel side walls 8, 8, arcuate end walls 9, 9 and end ports 10, 10 extending into open communication with the exterior of the primary rotor. A secondary circular rotor 11, having a peripheral seal ring 12, is mounted within the chamber 7 for relative rotary and lineal movement with respect thereto and is eccentrically affixed to a driven shaft 13 carried by the housing 5 for rotation about a fixed axis disposed in parallel offset relation with respect to the axis of the primary rotor 6. The housing 5 is provided with separate intake and exhaust ports, respectively indicated at 14 and 15, which are located in the path of rotation of the chamber ports 10 in order to become registered therewith as the primary rotor 6 rotates and a spark plug 16 is provided to initiate ignition.

Figure 7:
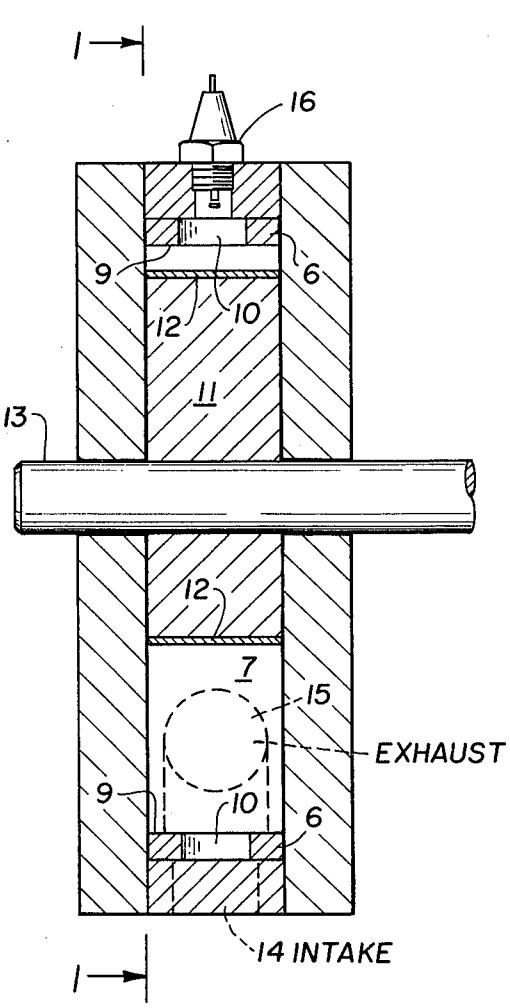
FIG. 7 is a longitudinal vertical section taken along line 7—7 of FIG. 1 with the relative positions of the intake and exhaust ports indicated in dotted lines in conformity with FIG. 1.
Figure 2:
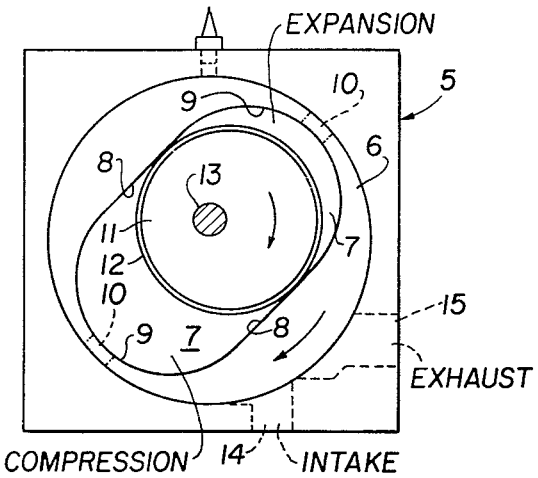
Figure 5:
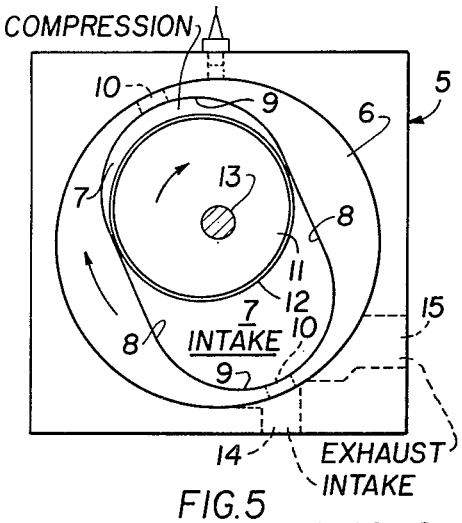
Figure 3:
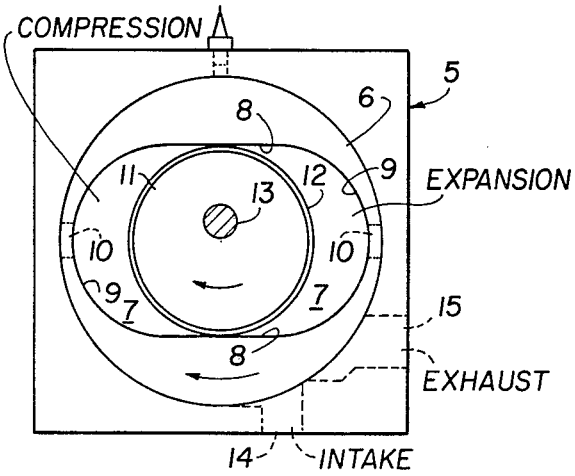
Figure 6:
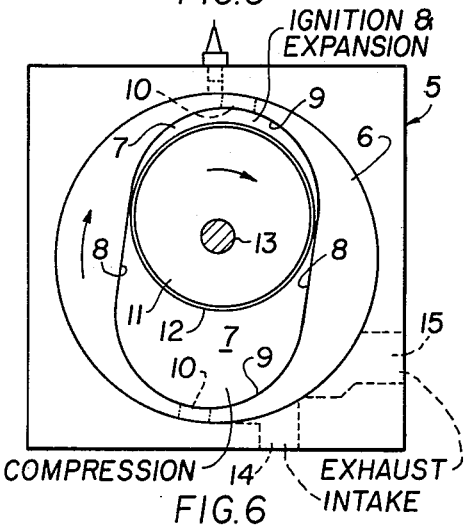
Figure 4:
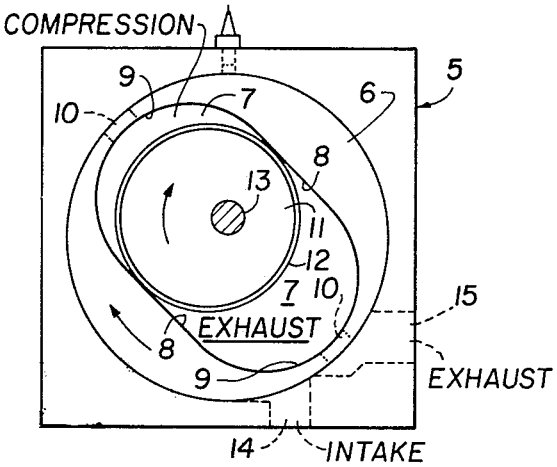

In the operation of the above described embodiment of the invention reference is made to FIGS. 1–7 in which FIGS. 1 and 7 show the parts at a 0° center where a compressed air-fuel charge is ready for ignition at the top of the chamber 7 and a new uncompressed air-fuel charge has been admitted or drawn into the bottom of the chamber 7, and previous startup has occurred so that rotation of the primary and secondary rotors and the driven shaft 13 is taking place in a clockwise direction. In FIG. 2 the primary rotor 6 has moved through an angle of 45° while the secondary rotor 11 has moved through an angle of 90° and power producing expansion of the combustibles in the upper right portion of the chamber 7 is taking place, while the newly admitted air-fuel charge at the lower left portion of the chamber 7 is becoming compressed prior to ignition. In FIG. 3 the primary rotor 6 has moved through an angle of 90° while the secondary rotor 11 has moved through an angle of 180°. This direct and relative rotation of the primary and secondary rotors, and the driven shaft 13, continues so that in the positions shown in FIG. 4 the port 10 at the expansion end of the chamber 7 is passing through registry across the exhaust port 15 to permit discharges of the fully combusted and expanded air-fuel mixture, while the opposite port 10 remains closed and the fresh air-fuel mixture at that end of the chamber 7 continues to undergo compression. At the positions shown in FIG. 5, the lower port 10 is passing through registry with the intake port 14 for admission of a new air-fuel mixture and the compressed air-fuel mixture at the opposite end of the chamber 7 is approaching the point at which ignition is to occur, while in FIG. 6, the primary rotors have just passed the dead center positions of FIG. 1 and a new power impulse is beginning as the result of ignition of the compressed air-fuel mixture at the top of the chamber 7.

At this point of the description it should perhaps be mentioned that the designation of the rotor 6 as the primary rotor and the rotor 11 as the secondary rotor is used only for the purposes of identification, rather than function, since their actual functions depend upon whether or not this rotary energy machine is engineered for use as an engine, a pump or the equivalents thereof: — if as an engine as described above, the shaft 13 becomes a driven shaft or if as a pump the shaft 13 becomes a driving shaft.

Also, with respect to the above described single unit embodiment of the invention as a two-cycle engine, it is necessary to balance or counterbalance the secondary rotor 11 in order to achieve substantially vibration-free operation.

In contrast, the modification and advance shown in FIGS. 8 and 9 provides an inherently self-balanced two-stage engine unit designed for substantially 360° power rotation.

In this embodiment the stationary housing 5 contains a circular primary rotor 17 provided with a first diametrically disposed front parallel-sided chamber 18 and a second diametrically disposed rear parallel-sided chamber 19 oriented at a 90° angle with respect to the front chamber 18 and separated therefrom by a median web 20 having a central aperture 21 to provide clearance around an offset mounted driven shaft 22 upon which is eccentrically mounted a compressor rotor 23 contained within the front chamber 18 and an eccentrically mounted power rotor 24 contained within the rear chamber 19.

Here, the front chamber 18 is provided with a pair of diametrically opposed end ports 25, 25 for controlling the admission and compression of air-fuel mixtures as will be hereinafter more fully described and the rear chamber 19 is similarly provided with a pair of diametrically opposed end ports 26, 26 for controlling admittance of the compressed air-fuel mixture to the ends of the chamber 19 and its exhaust or discharge therefrom upon completion of combustion and expansion.

For these purposes (see FIG. 8) the stationary housing 5 first is provided at its bottom with an intake port 27, in peripheral alignment with the compressor rotor 23, which communicates with an intake channel 28 formed in the inner wall of the housing 5 and extending around the periphery of the primary rotor 17 to a terminus adjacent the top of the housing and the stationary housing also is provided with a complementary compressor discharge channel 29 located as shown in the lower right quadrant of FIG. 8.

The stationary housing 5 secondly is provided at its bottom with an exhaust port 30, in peripheral alignment with the power rotor 24, which communicates with an exhaust channel 31 formed in the inner wall of the housing 5 and extending around substantially all of the right semi circle of the periphery of the primary rotor 17. A transverse (as viewed in FIG. 9) channel 32 is provided in the housing 5 adjacent the bottom thereof for effecting transfer of each compressed charge of air-fuel mixture from the terminal area of the channel 29 into an end portion of the primary rotor rear chamber 19 through one of the end ports 26 each time one of the ports 26 passes through registry therewith. A spark plug 33 is installed in the housing 5 at the bottom thereof in peripheral alignment with the power rotor 24 and in open communication with the associated end of the transverse channel 32 for ignition purposes.

A clear understanding of the operation of the embodiment shown in FIGS. 8 and 9 can best be gained if it is first understood that the relative positions of the primary rotor 17, the compressor rotor 23 and the power rotor 24 are such that the front chamber 18 is in a horizontal point in its clockwise rotation, the compressor rotor 23 is at its top center and the power rotor 24 is at its bottom center. At this stage, a new charge of air-fuel mixture is being drawn into the left end of the front chamber 18 via the intake port 27 and channel 28 while a previously induced charge of air-fuel mixture is being compressed in the right end of the front chamber 18. Simultaneously at this stage, a previously compressed pre-combustion charge of air-fuel mixture has become admitted to the bottom of the vertically positioned rear chamber 19, via the channels 29 and 32 as the power rotor 24 has approached its bottom center position, while a previously combusted and expanded charge of air-fuel mixture is ready to be exhausted or expelled from the top of the rear chamber 19 via the exhaust channel 31 and exhaust port 30.

Thus, in operation, each new charge of air-fuel mixture is drawn into an associated end of the front chamber 18, as the primary rotor 17 rotates, via the intake port 27, channel 28 and rotor end port 25. As the particular end of the front chamber 18 passes the upper terminus of the channel 28, the associated end port 25 becomes closed off by the wall of the housing 5 and compression of the air-fuel charge begins solely within that end of the front chamber 18 and continues, within a chamber collectively defined by the reducing volume of that end of the front chamber 18, the compressor discharge channel 29 and the transverse channel 32, as soon as the associated end port 25 passes into registry with the beginning of the compressor discharge channel 29.

Compression is maintained within the transverse channel 32 at this stage by the peripheral wall of the primary rotor 17 until one or the other of the end ports 26 of the rear chamber 19 thereof passes through registry therewith to admit the compressed air-fuel mixture into an associated end of the rear chamber 19 in preparation for ignition as soon as that particular end port has passed beyond registry with the transverse channel 32 into and through registry with the spark plug 33, thus producing a power impulse within that end of the rear chamber 19 as the primary rotor 17 continues to rotate.

Once the compressed air-fuel has become contained within the aartial chamber defined by the channels 29 and 32 as the result of passage of the associated end port 25 therebeyond, that end port and the associated end of the front chamber 18 again is in condition to draw in a fresh charge of air-fuel mixture as soon as that end port 25 passes through registry with the intake port 27 and its associated intake channel 28.

Concurrently, the ignited compressed air-fuel mixture at the bottom end of the rear chamber 19 expands until that end of the rear chamber 19 reaches its top center, at which point its associated end port 26 passes into and maintains registry with the exhaust channel 31 to effectively expel the combusted products therealong and through the exhaust port 30 as the relative motions between the power rotor 24 and the rear chamber 19 effect a progressive decrease in the volume of that end of the chamber.

Thus, the above described embodiment provides substantially a 360° power operation and inherently is self-balancing due to the 90° offset of the front and rear chambers 18 and 19 and to the 180° offset of the eccentrically mounted compressor and power rotors 23 and 24.

As mentioned above, the principles of this invention also may be readily adapted for use as a pump or compressor and in that connection, FIGS. 10 and 11 schematically illustrate a hydraulic pump constructed in accordance with this invention.

Here, the pump is organized as a twin delivery rotor single unit in order to provide a substantially 360° pumping operation and includes a stationary housing 34 within which is mounted a circular primary rotor 35 for rotation about its own fixed axis and which is provided with a symmetrical parallel-sided diametrically disposed front chamber 36 and an identical rear chamber 37 offset at a 90° angle with respect to the chamber 36 and separated therefrom by a median web 38 having a central aperture 39 to provide clearance for a housing-mounted drive shaft 40, the axis of which is in parallel offset relation to the axis of the primary rotor 35. A front delivery rotor 41, having a slip-ring seal 42 on its periphery is contained within the front chamber 36 and is eccentrically affixed to the drive shaft 40 for rotation therewith and a rear delivery rotor 43, also having a slip-ring seal 42 on its periphery, is contained within the rear chamber 37 and is eccentrically affixed to the drive shaft 40 at an 180° offset with respect to that of the front delivery rotor 41.

The front chamber 36 is provided with a pair of diametrically opposed end ports 44, 44 that are diagonally and radially directed rearwardly to the median periphery of the primary rotor 35 and the rear chamber 37 is provided with a similar pair of diametrically opposed end ports 45, 45 that are diagonally and radially directed forwardly to the median periphery of the primary rotor 35.

The housing 34 is provided at its top (see FIG. 10) with an inlet port 46 that opens into communication with an inlet channel 47 formed in the inner median wall of the housing around the general right half of the periphery of the primary rotor 35 and terminating adjacent the bottom thereof. The housing 34 also is provided at its top with an outlet port 48 that opens into communication with an outlet channel 49 formed in the inner median wall of the housing around the general left half of the periphery of the primary rotor 35 and terminating adjacent the bottom thereof at a location separated from the bottom terminus of the inlet channel 47.

In operation of the pump, the drive shaft 40 is powered by a suitable motor or other drive means to impart uniform clockwise rotory motion to the delivery rotors 41 and 43 and a corresponding clockwise differential rotary motion to the primary rotor 35. Assuming that the parts at startup are as shown in FIG. 10, the front delivery rotor 41 is at top center, its associated chamber 36 is vertically aligned and the twin or opposite delivery rotor 43 is at bottom center and its associated chamber 37 is horizontally aligned. As the top end port 44 of the primary rotor 35 passes through registry with the inlet port 46 fluid will be drawn in therethrough and along the inlet channel 47 as the effective volume of that end of the front chamber 36 progressively increases and the fluid will be admitted to the delivery channel 49 after the particular end port 44 passes out of registry with the inlet channel 47 and into continuing registry with the outlet channel 49 so that the fluid will be discharged under pressure from the outlet port 48 as the effective volume of that end of the front chamber 36 progressively decreases to the minimum as the delivery rotor 41 again approaches the top center position shown in FIG. 10, at which position the end port 44 has passed beyond continuing registry with the outlet channel 49 and the outlet port 48 is again ready to admit fluid through the inlet port 46 and inlet channel 47 as it moves through continuing registry therewith as heretofore described.

Each of the end ports 44, 44 and 45, 45, the respectively associated ends of the chamber 36 and 37 and the delivery rotors 41 and 43 function in the manner described above to collectively provide substantially a 360° functional operation of the pump. Thus, with the parts as shown in FIG. 10, the top of the front chamber 36 is ready to receive fluid through the inlet port 46, the bottom of the front chamber 36 is filled with fluid ready for discharge through the outlet port 48, the right end of the rear chamber 37 is receiving fluid through the inlet port 46 and the left end of the rear chamber 37 is discharging fluid through the outlet port 48, so that a substantially continuous intake and discharge of the pumped fluid is achieved.

In the event that wider porting at the ends of the chambers 36 and 37 and a consequent reduction in the lengths of the inlet and outlet channels 47 and 49 are required, as may be the case when extremely low viscosity fluids or gases are to be pumped or compressed, the chambers 36 and 37 may be open-ended as shown in FIG. 13, rather than closed and end-ported as previously described, while still retaining the slip-ring seals 42 on the delivery rotors. This of course would effect an oddly-shaped but still symmetrical plan profile at the ends of the chambers. Accordingly, if it is either desirable or necessary to maintain the generally lunate plan profile at the ends of the chambers for any purpose, the slip-ring seal 42 may be replaced by a modified slip-ring seal 50 as shown in FIG. 14, which has parallel sides for sliding engagement between the parallel side walls of the chambers of the primary rotor 35 and arcuate ends whose radii correspond to that of the periphery of the primary rotor 35.

It should be understood that, regardless of whether or not the principles of this invention are embodied in an engine, a pump or any other adaptation, it is important to assure that a 1:1 rotational ratio be maintained between the housing and the primary rotor, a 2:1 rotational ratio be maintained between the housing and the drive or driven shaft and a relative 1:1 rotational ratio be maintained between the primary rotor and any secondary rotor. Such ratios are established naturally by the relative dimensions of the parts in relation to the eccentricity of the secondary rotors and the parallel separation between the axis of the primary rotor and the axis of the drive or driven shaft and easily may be maintained, as shown in FIG. 12 for example, in which the driven shaft 13 is provided with a fixed pinion gear 51 for rotation within the aperture of the median web 20 and meshed with a complementary internal ring gear 52 affixed to the median web 20 of the primary rotor 17.

It should be further understood that, even though certain foregoing portions of this disclosure have described how the principles of this invention may be applied to a hydraulic pump, the same principles also are applicable to compressors for gaseous and vaporous substances. In this connection, FIGS. 15–27 are illustrative, of which certain of those figures are specific to constructional details that may be applicable to substantially all of the embodiments of this invention.

Thus, FIGS. 15 and 16 schematically illustrate a single rotary compressor unit that includes a stationary housing 53 within which is mounted a circular primary rotor 54 for rotation about its own fixed axis and which is provided with a symmetrical diametrically disposed internal chamber 55 provided with parallel side walls 56, 56, arcuate end walls 57, 57 and end ports 58, 58 extending into open communication with the exterior of the primary rotor. A secondary circular rotor 59, fitted around its outer periphery with a slip ring seal 60, is mounted within the chamber 55 for relative rotary and lineal movement with respect thereto and is eccentrically affixed to a driving shaft 61 carried by the housing 53 for rotation about a fixed axis disposed in parallel offset relation with respect to the axis of the primary rotor 54. The housing 53 is provided at its top with an inlet or suction port 62 that opens into communication with an inlet or suction channel 63 formed in the inner median wall of the housing around the general right half of the periphery of the primary rotor 54 and terminating adjacent the bottom thereof. The housing 53 also is provided at its top with an outlet or discharge port 64 that opens into communication with an outlet or discharge channel 65 formed in the inner median wall of the housing around the upper left quadrant of the periphery of the primary rotor 54 and terminating at a location well spaced from that of the bottom terminous of the inlet channel 63.

The inner wall of the housing 53 is provided with a plurality of spaced longitudinal recesses (not numbered) for the reception and retention of a corresponding number of roller seals 66 which bear against the periphery of the primary rotor 54.

In a somewhat comparable manner the slip ring seal 60 on the secondary rotor 59 may be made more effective by providing the parallel walls 56, 56 of the primary rotor 54 with spring loaded, generally cylindrical, seal elements 67, 67 that are adapted to bear against diametrically opposed portions of the slip ring seal 60.

As previously described in connection with FIG. 12, the desired rotational ratios of 1:1 between the housing 53 and the primary rotor 54, 2:1 between the housing 53 and the driving shaft 61 and the relative 1:1 between the primary rotor 54 and the secondary rotor 59 may be maintained by providing the driving shaft 61 with a fixed pinion gear 68 for operative engagement with a complementary internal ring gear 69 affixed within the primary rotor 54.

FIGS. 17 and 18 are detail views indicating how the spring loaded cylindrical seal elements 67 may be replaced either by a spring loaded combined wear plate and seal 70 or by a combined wear plate and seal 71 that is internally pressure loaded.

FIG. 19 is a view similar to FIG. 16 but showing a modification in which the slip ring seal 60 is replaced by a hollow ring seal 72 that may be internally pressure loaded through a radial duct 73 formed in the secondary rotor 59 and the driving shaft 61 for communication with an axial duct 74, which in turn may be operably connected to a suitable source of fluid pressure such as a bleed connection from the discharge of the compressor.

FIG. 20 is illustrative of one means by which sealing between certain faces of the components may be effected. Here, the primary rotor comprises a chamber-containing section 75 closed on its rear face by a freely mounted plate 76 that engages both the rear face of the section 75 and the rear face of a secondary rotor 77. The rear wall of the stationary housing is provided with an annular groove 78, concentric with the primary rotor, for receiving fluid loading pressure through a duct 79 to maintain proper face sealing pressure between the plate 76 and its associated elements.

FIG. 21 and 22 are illustrative of a two stage compressor that is similar to the two stage internal combustion engine described above in connection with FIGS. 8 and 9, and includes a stationary housing 80 that contains a circular primary rotor 81 provided with a first diametrically disposed front parallel-sided chamber 82 and a second diametrically disposed rear parallel-sided chamber 83 oriented at a 90° angle with respect to the front chamber 82 and separated therefrom by a median web 84 having a central aperture 85 to provide clearance around an offset mounted driving shaft 86 upon which is eccentrically mounted a first stage compressor rotor 87 contained within the front chamber 82 and an eccentrically mounted second stage compressor rotor 88 contained within the rear chamber 83.

The front chamber 82 is provided with a pair of diametrically opposed end ports 89, 89 for controlling the admission and first stage compression of the air or gas to be compressed and the rear chamber 83 is similarly provided with a pair of diametrically opposed end ports 90, 90 for controlling the admission of the air or gas from the first stage and its final compression and discharge.

For these purposes the stationary housing 80 first is provided at its bottom with a first stage intake or suction port 91, in peripheral alignment with the first stage compressor rotor 87, which communicates with a first stage suction channel 92 formed in the inner wall of the housing 80 and extending around the general left half of the periphery of the primary rotor 81 to a terminus adjacent the top of the housing; and the stationary housing also is provided with a complementary first stage discharge channel 93 located around the lower right quadrant of the primary rotor and having its lower end in communication with a bottom chamber 94, which in turn communicates with a second stage suction channel 95 in peripheral alignment with the second stage compressor rotor 88 and extending around the general left half of the periphery of the primary rotor 81 in a manner similar to that of the first stage suction channel 92. The inner wall of the housing 80 also is provided with a second stage discharge channel 96, complementary to the second stage suction channel 95, located around the lower right quadrant of the primary rotor 81 to a terminus in communication with a discharge port 97 formed in the housing.

It should be noted at this point that the dotted line representations in FIG. 21 of the second stage suction channel 95 and the second stage discharge channel 96 have been deliberately distorted as to the depths of those channels in order to illustrate their relative positions and extents. As a matter of fact, the cross-sectional areas of both of these second stage channels will be less than those of the corresponding first stage channels because first stage compression will have already taken place with a consequent reduction in volume.

In operation of this embodiment of the invention, and assuming clockwise rotation as viewed in FIG. 21, each time an end port 89 of the front chamber 82 passes through registry with the suction port 91 and the first stage suction channel 92, the air or gas will be drawn into that associated end of the chamber 82 and then will undergo first stage compression as that end of the chamber passes beyond communication with the upper terminus of the suction channel 92. The thus initially compressed air or gas then is transferred to an end portion of the rear chamber 83 via the bottom chamber 94 for second stage compression and discharge from the port 97.

FIGS. 23–26 illustrate a further embodiment of the invention in which a three chamber compressor may be created through the use of a componently fabricated primary rotor, the general principles of construction of which are readily adaptable to all of the embodiments of this invention.

In this embodiment a stationary housing generally indicated 98, having a closed rear face 99 and a removably mounted front plate 100, is provided with a cylindrical well (not numbered) for retention of a primary rotor generally indicated 101.

The primary rotor 101 is fabricated from three identical cylindrical components 102 (see FIG. 24), each having a rear wall 103 provided with a central aperture 104, and each being provided in its front face portion with a diametrically disposed parallelsided chamber 105 having a pair of oppositely disposed end ports 106, 106. The three components 102 are assembled axially in such relation that the successive parallel-sided chambers thereof preferably are angularly offset at 60° in order to provide proper balance, and the face of the front component is closed by a plate 107 having a central aperture (not numbered) corresponding to the apertures 104 in the rear walls of the components 102. Relative rotation between the components 102 is prevented by suitable means such as the interconnecting pins indicated at 108.

Each of the chambers 105 carries a secondary compressor rotor 109 eccentrically affixed to a drive shaft 110 journalled in the end walls of the housing 98 for rotation about an axis disposed in parallel offset relation with respect to that of the primary rotor 101.

Air or gas to be compressed is drawn into the successively presented ends of the chambers 105 through an intake or suction port 111 which communicates with an intake or suction chamber 112 formed in the wall of the housing 98 and extending around the general right half of the periphery of the primary rotor 101 and having an axial length sufficient to span and be in communication with all three sets of the end ports 106 of the parallel-sided chambers 105. The compressed air or gas is discharged through a complementary chamber 113 formed in the upper left quadrant of the wall of the housing 98 for communication with a discharge port 114.

A plurality of circumferentially spaced seals, such as roller seals 115 are mounted within the wall of the housing for sealing engagement with the periphery of the primary rotor 101 and slip ring or internally pressure loaded seals 116 are provided on the peripheries of the secondary rotors 109.

FIG. 27 is illustrative of the manner in which the principles of this invention may be applied to paired multiples of compressor units for operation from a single common drive shaft.

Here, a stationary housing generally indicated 117 is made up from a closed end front component 118, an intermediate divider component 119, and a rear component 120 covered by a rear plate 121. A two chamber primary and secondary compressor unit generally indicated 122 (and based upon the single chamber construction of FIGS. 15 and 16) is operably mounted within each section of the housing 118 for operation from a single common drive shaft 123, thus providing four individual compressor modules within a common housing. Of course, in such an arrangement the successive parallel-sided chambers of the primary rotors and their associated secondary rotors are angularly offset to the degree necessary to provide operational balance. For example, alternate pairs of the individual compressor modules may be angularly oriented in the same sense while the remaining alternate pairs may be angularly oriented such that their parallel-sided chambers are disposed at a 90° offset with respect to those of the first alternate pair. Also, it is possible to provide serially successive angular offsets from the first to the last individual module to provide the desired operational balance.

Furthermore, it should be understood that the previously described embodiments, or any modifications thereof, may be arranged in multiples for operation about a common drive or driven shaft or separately installed as multiple units that collectively may be connected to a common drive or driven shaft through suitable gearing or other power transfer means.

It also should be understood that while the various ports and channels have been described as illustrated in the several embodiments or modifications of the invention, such portings or channelings may be varied within wide limits, depending upon the end uses of the machines or upon the nature of the throughput gases, mixtures or liquids and the end result desired. It also should be understood that, in a somewhat broader sense, variations in arrangements and proportions of parts may be made within the scope of the appended claims.

I claim:

1. In a rotary compressor wherein is provided a fixed housing provided with a cylindrical chamber for receiving and operably supporting a primary rotor, a circular primary rotor mounted within the cylindrical chamber of said housing for rotation about it own fixed axis, said primary rotor being provided with a symmetrical diametrically-extending parallel-sided chamber, the opposed ends of said parallel-sided chamber being closed by arcuate end walls each of which is provided with an end port extending into open communication with the exterior of said primary rotor, and a circular secondary rotor operably positioned within the chamber of said primary rotor between the parallel sides thereof, said secondary rotor being eccentrically affixed to a drive shaft operably mounted in said housing for rotation about an axis disposed in parallel offset relation with respect to that of said primary rotor; said housing being provided with an inlet port extending into open communication with one end of a medianly disposed inlet channel formed in the wall of said cylindrical chamber in the general plane containing said end ports and extending around a substantial portion of the periphery of said primary rotor, said housing being provided with a discharge port separated from said inlet port and extending into open communication with one end of a medianly disposed discharge channel, complementary to said inlet channel, formed in the wall of said cylindrical chamber and extending around a portion of the periphery of said primary rotor generally opposite to that portion thereof embraced by said inlet channel, said secondary rotor being provided with a slip-ring seal mounted on the periphery thereof, the mid portions of the parallel walls of said parallel-sided chamber being provided with seal means for operative engagement with said slip-ring seal, said compressor also including a plurality of circumferentially spaced roller seals operably mounted in the wall of said cylindrical chamber for sealing engagement with the outer face of said primary rotor.

2. In a rotary compressor wherein is provided a fixed housing provided with a cylindrical chamber for receiving and operably supporting a primary rotor, a circular primary rotor mounted within the cylindrical chamber of said housing for rotation about its own fixed axis, said primary rotor being provided with a symmetrical diametrically-extending parallel-sided chamber, the opposed ends of said parallel-sided chamber being closed by arcuate end walls each of which is provided with an end port extending into open communication with the exterior of said primary rotor, and a circular secondary rotor operably positioned within the chamber of said primary rotor between the parallel sides thereof, said secondary rotor being eccentrically affixed to a drive shaft operably mounted in said housing for rotation about an axis disposed in parallel offset relation with respect to that of said primary rotor; said housing being provided with an inlet port extending into open communication with one end of a medianly disposed inlet channel formed in the wall of said cylindrical chamber in the general plane containing said end ports and extending around a substantial portion of the periphery of said primary rotor, said housing being provided with a discharge port separated from said inlet port and extending into open communication with one end of a medianly disposed discharge channel, complementary to said inlet channel, formed in the wall of said cylindrical chamber and extending around a portion of the periphery of said primary rotor generally opposite to that portion thereof embraced by said inlet channel, said secondary rotor being provided with a slip-ring seal mounted on the periphery therof, the mid portions of the parallel walls of said parallel-sided chamber being provided with seal means for operative engagement with said slip-ring seal, said compressor also including one or more additional symmetrical diametrically-extending parallel-sided chambers provided with opposed end ports and having their longitudinal axes successively angularly offset with respect to that of said first mentioned parallel-sided chamber, said additional parallel-sided chambers being separated from said first mentioned parallel-sided chamber and from each other by median webs each having a central aperture whereby to provide clearance around said shaft; and an additional circular secondary rotor operably positioned within each said additional parallel-sided chamber between the parallel sides thereof, each of said additional secondary rotors being eccentrically affixed to said shaft in successively angularly offset relation with respect to said first mentioned secondary rotor; said inlet and discharge channels each having a width sufficient to span all of the said end ports of all of the said end ports of all of the said parallel-sided chambers.

3. The rotary compressor of claim 2 in which said parallel-sided chambers and their associated secondary rotors are arranged as a plurality of modules, each containing one pair of said parallel-sided chambers and their associated secondary rotors.

4. The rotary compressor of claim 2 in which said slip-ring seal is replaced by an internally pressurized ring seal, and additionally including means for supplying pressure to said internally pressurized ring seal.

5. The rotary compressor of claim 2 additionally including gearing connections between said primary rotor and said shaft for maintaining a predetermined rotational ratio therebetween, said ratio being such that for a 1:1 rotational ratio between said housing and said primary rotor there will be a 2:1 rotational ratio between said housing and said secondary rotor and its associated shaft and a 1:1 relative rotational ratio between said primary and said secondary rotor and its associated shaft.

6. A rotary compressor including a fixed housing provided with a cylindrical chamber for receiving and operably supporting a primary rotor, a cylindrical primary rotor mounted within the cylindrical chamber of said housing for rotation about its own fixed axis; said primary rotor being provided with a first symmetrical diametrically-extending parallel-sided chamber having arcuate end walls each of which is provided with an end port extending into open communication with the exterior of said primary rotor, said primary rotor being provided with a second symmetrical diametrically-extending parallel-sided chamber having arcuate end walls each of which is provided with an end port extending into open communication with the exterior of said primary rotor; said second parallel-sided chamber having its longitudinal axis oriented at an angle with respect to that of said first parallel-sided chamber and being separated from said first parallel-sided chamber by a median web having a central aperture to provide clearance around a drive shaft; first and second secondary rotors respectively operably positioned between the parallel walls of said first and second parallel-sided chambers and being eccentrically affixed to a drive shaft extending through the aperture of said median web and journalled in said housing for rotation about an axis disposed in parallel offset relation with respect to the axis of rotation of said primary rotor; said housing being provided with an inlet port extending into open communication with one end of a first stage inlet channel formed in the wall of said cylindrical chamber in the general plane containing the end ports of said first parallel-sided chamber and extending around a substantial portion of the periphery of said primary rotor, said housing being provided with a first stage discharge channel complementary to said first stage inlet channel and extending around a separate portion of the periphery of said primary rotor; said housing being provided with a second stage inlet channel formed in the wall of said cylindrical chamber in the general plane containing the end ports of said second parallel-sided chamber and being substantially coextensive in length with said first stage inlet channel, the intake end of said second stage inlet channel being chamber-connected to the discharge end of said first stage discharge channel, said housing being provided with a second stage discharge channel complementary to said second stage inlet channel and extending around a separate portion of the periphery of said primary rotor in general association with said first stage discharge channel, said second stage discharge channel having one end extending into open communication with a discharge port formed in said housing.

7. The rotary compressor of claim 6 additionally including gearing connections between said primary rotor and said shaft for maintaining a predetermined rotational ratio therebetween, said ratio being such that for a 1:1 rotational ratio between said housing and said primary rotor there will be a 2:1 rotational ratio between said housing and said secondary rotors and their associated shaft and a 1:1 relative rotational ratio between said primary and said secondary rotors and their associated shaft.

8. The rotary compressor of claim 6 additionally including a plurality of circumferentially spaced roller seals operably mounted in the wall of said cylindrical chamber for sealing engagement with the outer face of said primary rotor.

9. The rotary compressor of claim 6 additionally including a slip-ring seal mounted on the periphery of each of said secondary rotors.

10. The rotary compressor of claim 9 additionally including seal means operably mounted in the mid portions of the parallel walls of said parallel-sided chambers for relative sliding engagement with said slip-ring seals.

11. The rotary compressor of claim 9 in which each said slip-ring seal is replaced by an internally pressurized ring seal, and additionally including means for supplying pressure to each said internally pressurized ring seal.

* * * * *